US011701888B2

(12) United States Patent
Nagai

(10) Patent No.: US 11,701,888 B2
(45) Date of Patent: Jul. 18, 2023

(54) CONTAINER FOR LIQUID REPLENISHMENT AND LIQUID REPLENISHMENT STRUCTURE

(71) Applicant: CANON KABUSHIKI KAISHA, Tokyo (JP)

(72) Inventor: Masataka Nagai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 17/210,267

(22) Filed: Mar. 23, 2021

(65) Prior Publication Data

US 2021/0300049 A1 Sep. 30, 2021

(30) Foreign Application Priority Data

Mar. 31, 2020 (JP) ..... 2020-062943

(51) Int. Cl.
*B41J 2/175* (2006.01)
*B65D 5/74* (2006.01)

(52) U.S. Cl.
CPC ..... *B41J 2/17506* (2013.01); *B65D 5/74* (2013.01)

(58) Field of Classification Search
CPC .... B41J 2/17506; B41J 2/175; B41J 2/17503; B41J 2/17513; B41J 2/17523; B41J 2/1754; B41J 2/17553; B41J 2/17596; B41J 29/13; B65D 5/74
USPC ..... 222/556, 571, 325; 347/84–87
See application file for complete search history.

(56) References Cited

U.S. PATENT DOCUMENTS

| | | | | |
|---|---|---|---|---|
| 8,579,424 | B2 * | 11/2013 | Haijima | B41J 2/17523 347/86 |
| 2005/0140749 | A1 * | 6/2005 | Usui | B41J 2/17523 347/84 |
| 2016/0200110 | A1 * | 7/2016 | Matsushita | B65D 51/20 347/85 |
| 2019/0030903 | A1 * | 1/2019 | Fukasawa | B41J 29/13 |

FOREIGN PATENT DOCUMENTS

| | | | |
|---|---|---|---|
| CN | 104417074 | A | 3/2015 |
| CN | 105793050 | A | 7/2016 |
| CN | 206394243 | U | 8/2017 |
| CN | 107487086 | A | 12/2017 |
| CN | 109318598 | A | 2/2019 |
| EP | 0634976 | A | 1/1995 |
| JP | 2003182101 | A | 7/2003 |
| JP | 3128237 | U | 12/2006 |
| JP | 2019025782 | A | 2/2019 |

* cited by examiner

*Primary Examiner* — Lien M Ngo
(74) *Attorney, Agent, or Firm* — Canon U.S.A., Inc.IP Division

(57) ABSTRACT

A container for liquid replenishment for replenishing liquid in a liquid ejection apparatus comprises a container body capable of containing the liquid, a spout fitted to the container body and having a front end section including a front end surface and a liquid outlet for allowing the liquid to flow out therefrom, a lid member removably attached to the spout to cover the spout and a liquid absorber arranged on the spout. The liquid outlet is open in the front end surface of the spout and the liquid absorber is arranged at least on an area of the front end surface not occupied by the liquid outlet.

13 Claims, 7 Drawing Sheets

CONTAINER FOR LIQUID REPLENISHMENT AND LIQUID REPLENISHMENT STRUCTURE

BACKGROUND

Field of the Disclosure

The present disclosure relates to a container for liquid replenishment and a liquid replenishment structure to be used to replenish the liquid in a liquid ejection apparatus.

Description of the Related Art

Liquid ejection apparatus such as inkjet recording apparatus require liquid to be ejected therefrom. Liquid that is ejected from liquid ejection apparatus is normally referred to as recording liquid, which typically is ink. When replenishing the liquid in such an apparatus, a container for liquid replenishment that is filled with liquid in advance is employed and the liquid outlet of the container for liquid replenishment is directed downward and connected to the inlet flow path member of the apparatus. Then, the liquid in the apparatus is replenished from the container for liquid replenishment by way of the inlet flow path member. Desirably, the liquid outlet of the container for liquid replenishment is directed upward and kept in an upright position when the container is not in use and held in storage. However, it may not always be able to assure that the liquid outlet of the container for liquid replenishment can reliably be directed upward and kept in an upright position when the container is not in use and held in storage. In other words, the liquid outlets of containers for liquid replenishment are required to reliably be provided with an excellent sealing feature. Japanese Patent Application Laid-Open No. 2019-25782 discloses a container for liquid replenishment comprising a spout having a liquid outlet, a lid member to be removably fitted to the spout and a liquid absorber arranged on the inner surface of the lid member in order to absorb liquid and provide an effect of reducing the liquid leakage from the container whenever the lid member is fitted to the spout.

While a container for liquid replenishment described in Japanese Patent Application Laid-Open No. 2019-25782 provides an effect of reducing the liquid leakage from the container when the lid member is fitted to the spout, spillage from the container for liquid replenishment in an operation of replenishing the liquid in the apparatus may remain, particularly when the container for liquid replenishment needs to be fitted to and removed from the apparatus a plurality of times.

SUMMARY

One aspect of the present disclosure is to provide a container for liquid replenishment that can reduce the amount of liquid that splashes around the inlet flow path member of the liquid ejection apparatus containing the liquid to be replenished from the container and minimize the problem of a loss of liquid.

In an aspect of the present disclosure, there is provided a container for liquid replenishment for replenishing liquid in a liquid ejection apparatus, the container comprising a container body capable of containing the liquid; a spout fitted to the container body and having a front end section including a front end surface and a liquid outlet for allowing the liquid to flow out therefrom; a lid member removably attached to the spout to cover the spout; and a liquid absorber arranged on the spout; the liquid outlet being open in the front end surface of the spout; the liquid absorber being arranged at least on an area of the front end surface not occupied by the liquid outlet.

Further features of the present disclosure will become apparent from the following description of exemplary embodiments with reference to the attached drawings.

DESCRIPTION OF THE EMBODIMENTS

Figure 1:
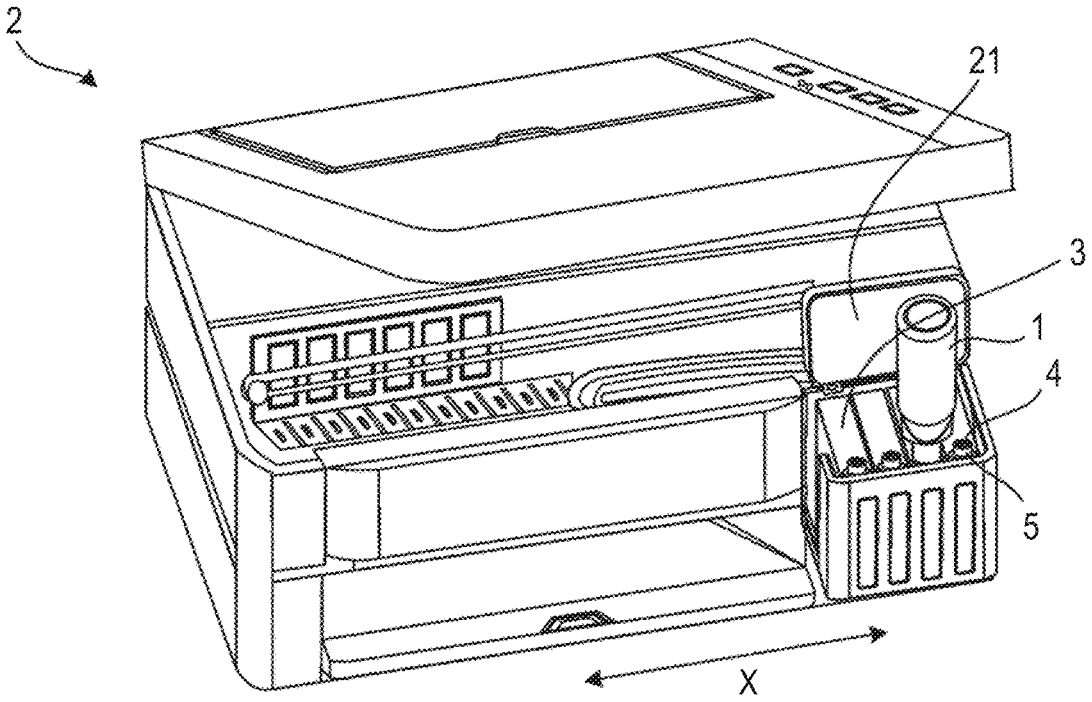
FIG. 1 is a schematic perspective view of an inkjet recording apparatus, illustrating how the recording liquid of the apparatus is replenished.

Now, the present disclosure will be described in greater detail by referring to the accompanying drawings that illustrate currently preferable embodiments of the present disclosure. Note that, the same components are denoted respectively by the same reference numerals throughout the accompanying drawings and will not be described repeatedly in the following description of the disclosure. To begin with, an inkjet recording apparatus that operates for recording by ejecting recording liquid (e.g., ink) toward a recording medium such as a sheet of paper will be described as an exemplar apparatus that needs to use liquid for its operation. Recording liquid is an exemplar liquid required by an apparatus that employs liquid for its recording operation. The liquid contained in such an inkjet recording apparatus (liquid ejection apparatus) is replenished by means of a container for liquid replenishment that is filled with recording liquid in advance. FIG. 1 schematically illustrates how the recording liquid of the inkjet recording apparatus is replenished.

Referring to FIG. 1, the inkjet recording apparatus 2 comprises a carriage (not shown) that can move back and forth in the X-direction indicated in FIG. 1. An inkjet recording head for ejecting recording liquid toward the surface of the recording medium to be used for recording is mounted in the carriage. Tanks 3 storing recording liquid to be ejected toward the recording medium are also arranged in the inkjet recording apparatus 2 and recording liquid is supplied from the tanks 3 by way of flexible tubes (not shown). In the instance of the inkjet recording apparatus 2 shown in FIG. 1, recording liquids of four different colors are employed by the apparatus to record a multicolor image on the recording medium by multicolor recording. Thus, the inkjet recording apparatus 2 contains a total of four tanks 3 for containing recording liquids of the four different colors. When the amount of recording liquid remaining in one of the tanks 3 is reduced and becomes small, the recording liquid in the tank 3 that contains only the reduced amount of recording liquid is replenished from a container for liquid replenishment 1 that is filled with recording liquid of the same color in advance. For the purpose of liquid replenishment, each of the tanks 3 is provided with a cylindrical inlet section 5 projecting upward from the top surface of the tank 3. A circular recess is formed on the top surface of the inlet section 5 of the tank 3 and a cylindrical and tubular inlet flow path member 4 is arranged to extend upward from the center of the recess. When the recording liquid in the tank 3 is to be replenished from the container for liquid replenishment 1, the container for liquid replenishment 1 is turned upside down and the inlet flow path member 4 of the tank 3 is inserted into the liquid outlet of the container for liquid replenishment 1 to reliably connect the liquid outlet of the container for liquid replenishment 1 to the inlet flow path member 4 of the tank 3. Thus, at this time, the container for liquid replenishment 1 is forced to take a posture where the liquid outlet side of the container faces downward and then the recording liquid in the container for liquid replenishment 1 flows into the tank 3 from the liquid outlet of the container by way of the inlet flow path member 4 of the tank 3. Note that an openable and closable cover 21 is provided to cover the tanks 3 in the inkjet recording apparatus 2. Thus, when there is not any operation of replenishing the recording liquid in any of the tanks 3, the tanks 3 are covered by the cover 21.

Figure 2A:
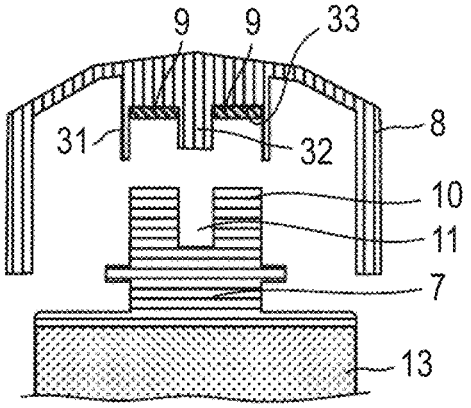
FIGS. 2A, 2B and 2C are a schematic illustration of a container for liquid replenishment having a liquid absorber arranged on the lid member of the container.
Figure 2B:
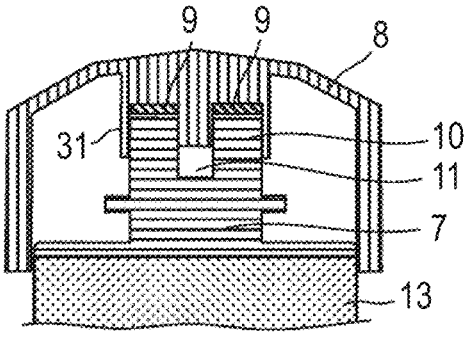
Figure 2C:
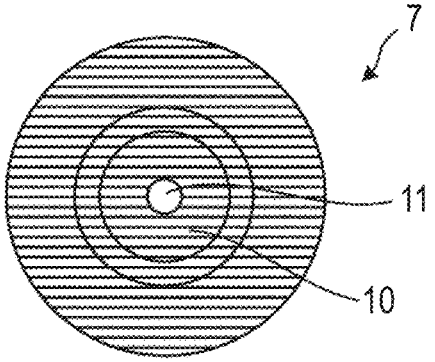

FIGS. 2A through 2C are a schematic illustration of a principal part of a prior art container for liquid replenishment 1 that comprises a lid member 8 and a liquid absorber 9 attached to the lid member 8. FIG. 2A is a schematic cross-sectional view of the container for liquid replenishment 1 when the lid member 8 of the container 1 is removed and separated from the container body 13 of the container 1, whereas FIG. 2B is a schematic cross-sectional view of the container for liquid replenishment 1 when the lid member 8 of the container 1 is put on the container body 13 of the container 1. FIG. 2C is a schematic top view of the container for liquid replenishment 1 from which the lid member 8 is removed. Thus, the container for liquid replenishment 1 comprises a cylindrical container body 13 that can store recording liquid in it and a column-shaped spout 7 fitted to the upper surface of the container body 13 so as to project upward from the container body 13. A liquid outlet 11, from which the liquid contained in the container body 13 can flow out, is open at the front end surface of the front end section 10 of the spout 7. Although not shown in FIGS. 2A through 2C, a movable seal member is arranged in the flow path between the container body 13 and the liquid outlet 11 to block the communication between the container body 13 and the liquid outlet 11 when the container for liquid replenishment 1 is not in operation of replenishing the recording liquid in the tank 3. As a result of this arrangement, if the container for liquid replenishment 1 is turned upside down to face downward and left unattended, the risk that the recording liquid in the container body 13 flows out from the inside is minimized. When, on the other hand, the recording liquid in the tank 3 is to be replenished from the container for liquid replenishment 1, the liquid outlet 11 is made to face downward and the container for liquid replenishment 1 is brought down until it extends into the tank 3. Then, as a result, the front end of the inlet flow path member 4 of the tank 3 penetrates into the liquid outlet 11 of the container for liquid replenishment 1 to push up the seal member and the seal member is released from its position of contacting the inside of the container body 13 to consequently establish a flow path that allows the inside of the container body 13 to communicate with the liquid outlet 11. Then, as a result, the recording liquid in the container body 13 flows from the liquid outlet 11 into the inlet flow path member 4 of the tank 3 and fed into the tank 3.

A lid member 8 is removably fitted to the container for liquid replenishment 1 for the purpose of protecting the spout 7 including the liquid outlet 11 thereof. The lid member 8 has a curved top part that is provided on the inner surface thereof with a cylindrical and tubular section 31 that can receive the front end section 10 of the spout 7 and a straight protrusion 32 of a shape that is suited to be inserted into the liquid outlet 11 formed in the spout 7. The straight protrusion 32 extends along the center axis of the tubular section 31 of the lid member 8. The tubular section 31 has a closed end facet 33 at the rear end thereof located oppositely relative to the front end thereof that is adapted to receive the front end section 10 of the spout 7. A liquid absorber 9 that can absorb recording liquid is attached to the end facet 33 of the tubular section 31 except the area where the straight protrusion 32 is arranged. A fabric material such as cellulose or a polymeric material that can absorb recording liquid and hold the absorbed recording liquid is employed for the liquid absorber 9. FIG. 2B shows the container for liquid replenishment 1 to which the lid member 8 has already been attached. As the lid member 8 is put on the container for liquid replenishment 1, the front end section 10 of the spout 7 into the tubular section 31 of the lid member 8 and the liquid outlet 11 is closed by the straight protrusion 32. At the same time, the liquid absorber 9 attached to the lid member 8 is placed vis-a-vis the front end section 10 of the spout 7 in the inside of tubular section 31 of the lid member 8. Thus, the recording liquid in the container for liquid replenishment 1 is prevented from leaking out through the liquid outlet 11 and, if the recording liquid ever leaks out from the liquid outlet 11, the recording liquid that has leaked out is absorbed by the liquid absorber 9. Therefore, the risk that recording liquid leaks out from the container for liquid replenishment 1 and contaminates the outside of the container for liquid replenishment 1 is minimized.

However, when the liquid absorber 9 is attached to the lid member 8 and if the operation of fitting the container for liquid replenishment 1 to and removing it from the corresponding one of the tanks 3 is frequently repeated, recording liquid can adhere to the outer surface of the spout 7 and then splash around to get to the surface of the inkjet recording apparatus. Additionally, since the recording liquid absorbed by the liquid absorber 9 will ultimately be thrown away with the lid member 8 and hence the recording liquid absorbed by the liquid absorber 9 will simply become an economic loss. On the other hand, in a container for liquid replenishment 1 according to the present disclosure, the liquid absorber 9 for absorbing the recording liquid leaking out from the liquid outlet 11 is arranged not on the lid member 8 but on the side of the spout 7 to eliminate the problems that will arise when the liquid absorber 9 is arranged on the lid member 8. A container for liquid replenishment 1 according to the present disclosure can be embodied in various different ways depending on the structure of the spout 7, the corresponding structure of the lid member 8, the position where the liquid absorber 9 is arranged and other factors. Now, various currently preferable embodiments of a container for liquid replenishment according to the present disclosure will be described below.

First Embodiment

Figure 3A:
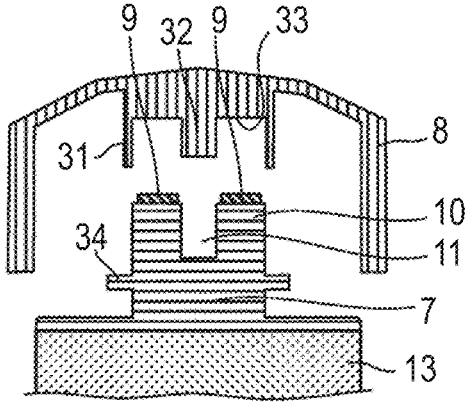
FIGS. 3A, 3B, 3C, 3D, 3E and 3F are a schematic illustration of the first embodiment of container for liquid replenishment according to the present disclosure.
Figure 3B:
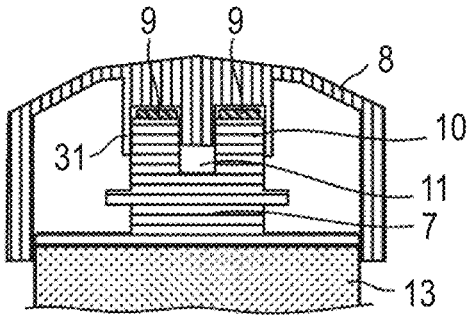
Figure 3C:
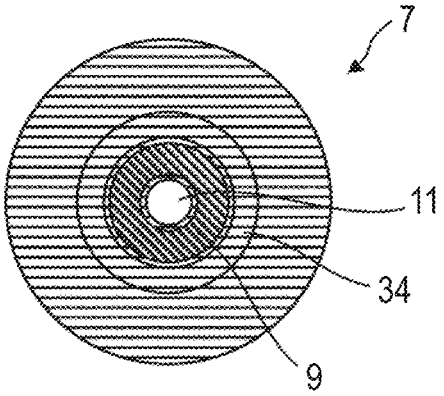
Figure 3D:
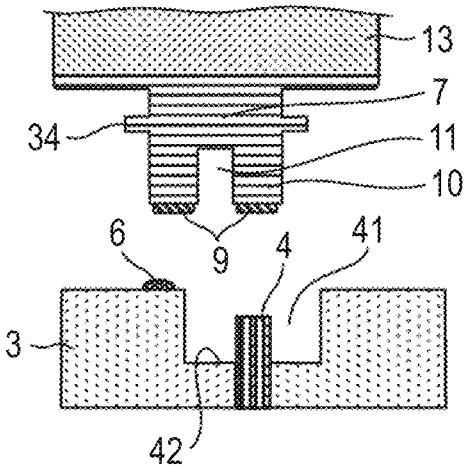
Figure 3E:
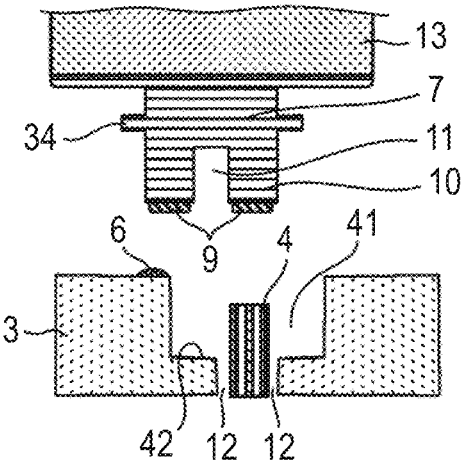
Figure 3F:
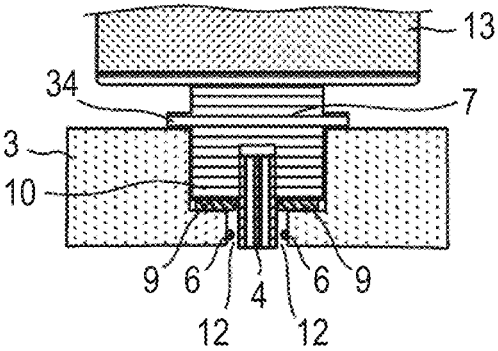

FIGS. 3A through 3F are a schematic illustration of the first embodiment of container for liquid replenishment according to the present disclosure. FIGS. 3A and 3B are schematic cross-sectional views of a principal part of the container for liquid replenishment 1 of the first embodiment. The lid member 8 is taken away from the container body 13 in FIG. 3A, whereas the lid member 8 is fitted to the container body 13 in FIG. 3B. FIG. 3C is a schematic top view of the container for liquid replenishment 1, from which the lid member 8 is taken away. FIG. 3D is a schematic cross-sectional view of a principal part of the container for liquid replenishment 1 immediately before it is fitted to a tank 3 to be mated with the container 1. FIGS. 3E and 3F are schematic cross-sectional views of an embodiment of container for liquid replenishment 1 obtained by modifying the first embodiment as will be described in greater detail hereinafter. Note that, for the embodiments shown in FIGS. 3A through 3F and the drawings that follow, unlike the tanks 3 shown in FIG. 1, the corresponding tanks 3 are not provided with any inlet section 5 that projects upward from the top surface of the tank 3. Instead, a circular recess 41 is formed on the top surface of each of the tanks 3 and an inlet flow path member 4 is projecting upward from the center of the bottom surface 42 of the recess 41. The inlet flow path member 4 is held in communication with the inside of the tank 3.

As in the instance illustrated in FIGS. 2A through 2C, the container for liquid replenishment 1 of this embodiment comprises a cylindrical container body 13 that actually stores recording liquid in it, a column-shaped spout 7 fitted to the upper surface of the container body 13 and upwardly projecting therefrom and a lid member 8 removably fitted to the container body 13. The container for liquid replenishment 1 of the first embodiment differs from the container for liquid replenishment shown in FIGS. 2A through 2C in that the liquid absorber 9 of this embodiment is not arranged on the lid member 8 but fitted to the front end surface of the front end section 10 of the spout 7. Because the recording liquid contained in the container body 13 needs to be allowed to flow out from the container body 13 by way of the liquid outlet 11, which is arranged at the center of the front end section 10 of the spout 7, the liquid absorber 9 is arranged on the front end surface of the front end section 10 of the spout 7 except the area of the liquid outlet 11 such that the liquid absorber 9 shows an annular profile in plan view as seen from FIG. 3C. The liquid absorber 9 of this embodiment is made of a material similar to the one employed for the liquid absorber 9 described above by referring to FIGS. 2A through 2C. When the lid member 8 is fitted to the container body 13, the recording liquid leaking out from the liquid outlet 11 is absorbed by the liquid absorber 9 as in the instance of FIGS. 2A through 2C and hence the risk that the recording liquid leaking out from the container for liquid replenishment 1 contaminates the outside is minimized.

When the recording liquid in the tank 3 is to be replenished from the container for liquid replenishment 1 of this embodiment, the lid member 8 is removed from the container body 13 of the container for liquid replenishment 1 and the container body 13 is turned upside down with the spout 7 to make the front end section 10 of the spout 7 face downward as shown in FIG. 3D. As the front end section 10 is made to face downward, the part of the container for liquid replenishment 1 that comes close to the tank 3 first is the liquid absorber 9. Thus, if the droplets 6 of the recording liquid 3 that splashed around during the last operation of replenishing the recording liquid in the tank 3 are still adhering to the surface of the tank 3, the droplets 6 can be wiped out by means of the liquid absorber 9 to minimize the risk that the contamination by the recording liquid spreads further. When the container for liquid replenishment 1 is fitted to the tank 3, the inlet flow path member 4 of the tank 3 is put deep into the inside of the liquid outlet 11 of the spout 7 until the bottom surface 42 of the recess 41 is placed face to face the liquid absorber 9 on the side of the spout 7.

With the above-described first embodiment, the recording liquid that has leaked out from the container for liquid replenishment 1 is absorbed by the liquid absorber 9. Therefore, the amount of recording liquid that will ultimately be discarded can be reduced by collecting the recording liquid absorbed by the liquid absorber 9 and putting the collected recording liquid back into the tank 3. An arrangement for collecting the recording liquid absorbed by the liquid absorber 9 into the tank 3 with ease will be described below by referring to FIGS. 3E and 3F, which illustrate an embodiment obtained by modifying the first embodiment. FIGS. 3E and 3F are cross-sectional views of a principal part of this modified embodiment. More specifically, FIG. 3E shows the container for liquid replenishment 1 of the modified embodiment before it is fitted to the tank 3, whereas FIG. 3F shows the container for liquid replenishment 1 of the modified embodiment that is already fitted to the tank 3. In this modified embodiment, a droplet collection port 12 is formed on the bottom surface 42 of the recess 41 of the tank 3 at a position located adjacent to the inlet flow path member 4 and the droplet collection port 12 is held in communication with the inside of the tank 3. As the container for liquid replenishment 1 is fitted to the tank 3 as shown in FIG. 3F, the liquid absorber 9 fitted to the front end section 10 of the spout 7 is pinched between the spout 7 and the bottom surface 42 of the recess 41 and compressed. Then, as a result, the liquid absorber 9 is forced to contract and the recording liquid absorbed in the liquid absorber 9 is squeezed out as droplets 6 and flows into the droplet collection port 12 so as to be fed back into the tank 3. The spout 7 of the container for liquid replenishment 1 is provided with an annular protrusion 34 that will eventually come into contact with the edge of the recess 41 on the upper surface of the tank 3 to prevent the liquid absorber 9 from being excessively compressed when the front end section 10 of the spout 7 is brought deep into the recess 41 of the tank 3.

Second Embodiment

Figure 4A:
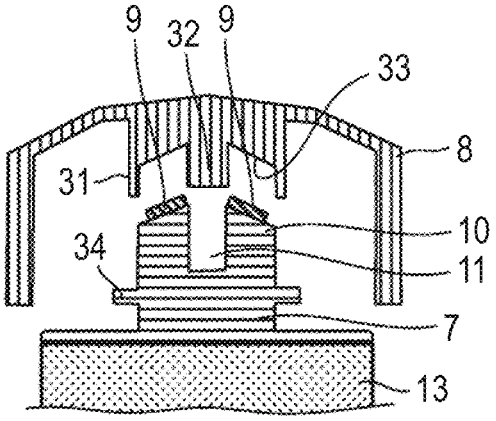
FIGS. 4A and 4B are schematic cross-sectional views of the second embodiment of container for liquid replenishment according to the present disclosure.
Figure 4B:
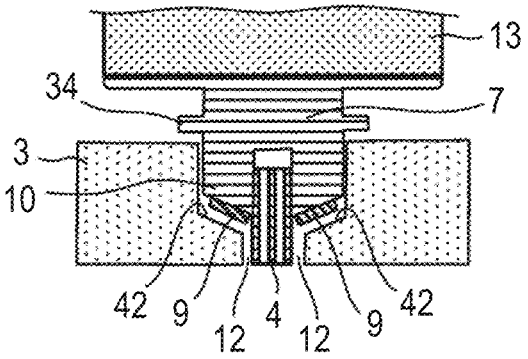

FIGS. 4A and 4B are schematic cross-sectional views of the second embodiment of container for liquid replenishment according to the present disclosure. FIG. 4A shows a principal part of the container for liquid replenishment 1 of this embodiment and FIG. 4B also shows a principal part of the container for liquid replenishment 1 that is already fitted to a tank 3. For the purpose of the present disclosure, the profile of the front end section 10 of the spout 7 and the profile of the tubular section 31 of the lid member 8 that is made to match the profile of the front end section 10 are not limited to those of the first embodiment described above and shown in FIGS. 3A through 3F. In this second embodiment, the front end surface of the front end section 10 of the spout 7 is made to show a substantially conical profile, although the pointed center tip of the cone is moved away to produce a liquid outlet 11 there. In other words, the imaginary pointed center tip of the conical profile is projecting toward the lid member 8. To match the above-described profile and to make the lid member 8 show a profile that is complementary relative to the profile of the front end surface of the front end section 10 of the spout 7, the end facet 33 of the tubular section 31 of the lid member 8 is made to show a profile that gradually recedes toward the center thereof to become dented. Additionally and correspondingly, the bottom surface 42 of the recess 41 of the tank 3 is also made to show a profile that gradually recedes toward the center thereof to become dented. Thus, the bottom surface 42 of the bottom section 41 of the tank 3 is formed as a sloped surface that is downwardly inclined from the outer peripheral side toward the center of the bottom surface 42 and the angle of inclination is made to be substantially equal to the angle of inclination of the front end section 10 of the spout 7. The droplet collection port 12 of the tank 3 is arranged at a position located adjacent to the inlet flow path member 4 on the bottom surface 42 of the tank 3 as in the instance of the above-described modified embodiment of the first embodiment.

In this embodiment again, the liquid absorber 9 is arranged on the front end surface of the front end section 10 of the spout 7.

The liquid absorber 9 shows a profile that rises high at the center side thereof if compared with the outer peripheral side. While such a profile on the part of the liquid absorber 9 does not provide any disadvantage from the viewpoint of removing the liquid droplets 6 that have splashed around and are adhering to the surface of the tank 3, it is advantageous from the viewpoint of feeding the liquid droplets 6 squeezed out from the liquid absorber 9 back into the tank 3 because, when the container for liquid replenishment 1 is attached to the tank 3, the droplets 6 of the recording liquid absorbed by the liquid absorber 9 but squeezed out from the liquid absorber 9 smoothly flow toward the droplet collection port 12 due to the downwardly inclined profile of the bottom surface 42 of the recess 41 of the tank 3. As the droplets of the recording liquid can easily flow toward the droplet collection port 12, the liquid droplets 6 can efficiently be fed into the tank 3.

Third Embodiment

Figure 5A:
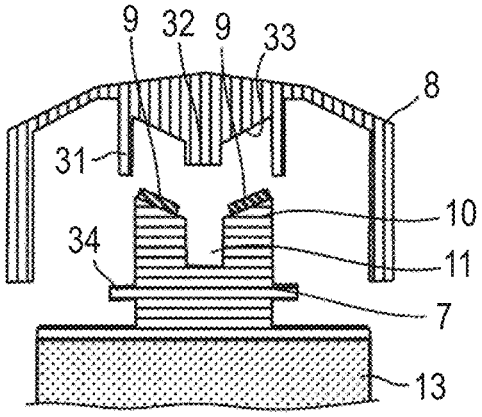
FIGS. 5A, 5B, 5C and 5D are schematic cross-sectional views of the third embodiment of container for liquid replenishment according to the present disclosure.
Figure 5B:
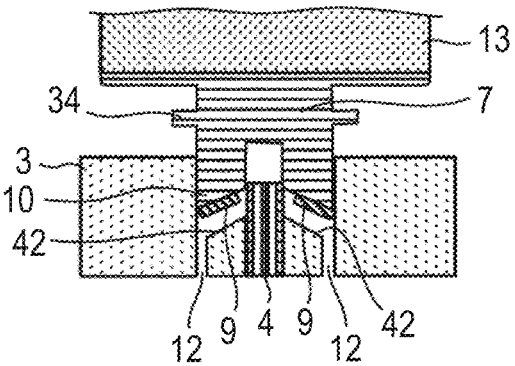
Figure 5C:
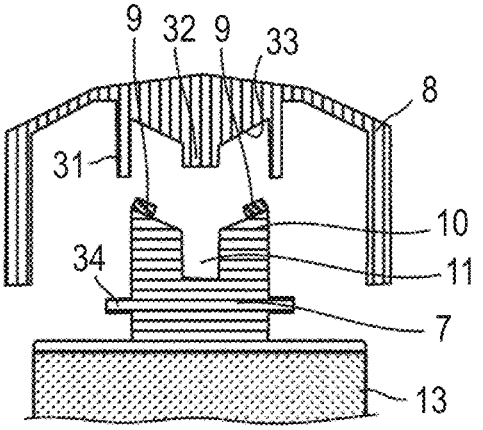
Figure 5D:
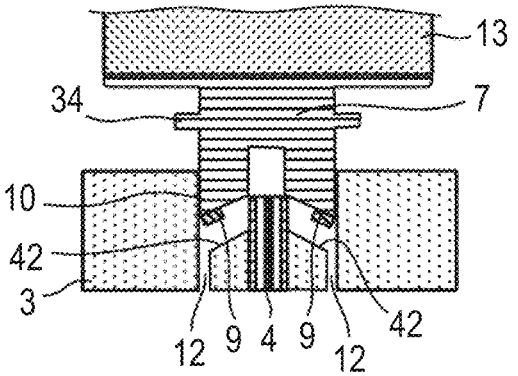

FIGS. 5A through 5D are schematic cross-sectional views of the third embodiment of the present disclosure. FIG. 5A shows a principal part of the container for liquid replenishment 1 of the third embodiment and FIG. 5B shows a principal part of the container for liquid replenishment 1 that has already been attached to a tank 3. FIGS. 5C and 5D are a schematic illustration of an embodiment obtained by modifying the third embodiment as will be described in greater detail hereinafter. As shown in FIGS. 5A and 5B, in the container for liquid replenishment 1 of this embodiment again, the liquid absorber 9 is fitted to the front end surface of the front end section 10 of the spout 7 but the front end surface of the front end section 10 is made to show a substantially inverted conical profile, although the pointed center tip of the cone is moved away to produce a liquid outlet 11 there. In other words, the imaginary pointed center tip of the inverted conical profile is projecting downward to move away from the lid member 8 such that the front end surface of the front end section 10 recedes to become dented on the center side thereof and rises high on the outer peripheral side. To match the above-described profile and to make the lid member 8 show a profile that is complementary relative to the profile of the front end surface of the front end section 10 of the spout 7, the end facet 33 of the tubular section 31 of the lid member 8 is made to project downward on the center side thereof. Additionally and correspondingly, the bottom surface 42 of the recess 41 of the tank 3 is formed as a slope section whose surface is upwardly inclined from the outer peripheral side toward the center of the bottom surface 42 and the angle of inclination is made to be substantially equal to the angle of inclination of the front end section 10 of the spout 7. The droplet collection port 12 of the tank 3 is arranged at a position located along the outer periphery of the bottom surface 42 of the tank 3.

With this embodiment again, when the container for liquid replenishment 1 is fitted to the tank 3, the droplets 6 of the recording liquid squeezed out from the liquid absorber 9 smoothly flows toward the droplet collection port 12. Then, as the droplets 6 of the recording liquid squeezed out from the liquid absorber 9 can flow with ease, the risk that some of the liquid droplets 6 that have once been squeezed out from the liquid absorber 9 stick back to the liquid absorber 9 is minimized so that the liquid droplets 6 can highly efficiently be fed back into the tank 3. Additionally, the front end surface of the front end section 10 of the spout 7 is made to be an inclined surface and the outer peripheral part of the front end surface rises higher than the center part of the front end surface and hence the liquid droplets 6 that are likely to leak out from the liquid outlet 11 can be prevented from actually leaking out both by the effect of the inclined surface and by the absorption effect of the liquid absorber 9. Then, the net result will be that the container for liquid replenishment 1 of the third embodiment can more effectively prevent droplets of recording liquid from leaking out therefrom than the container for liquid replenishment 1 of the second embodiment. On the other hand, however, since the liquid absorber 9 of the third embodiment shows an inclined profile and positioned lower on the center side than on the outer peripheral side thereof and the effectiveness of the operation of removing the splashing liquid droplets 6 of the third embodiment can slightly be lower than that of the first embodiment and that of the second embodiment.

With the container for liquid replenishment 1 of the third embodiment, the liquid absorber 9 may be fitted to a limited area of the front end surface of the front end section 10 of the spout 7 that is located close to the outer periphery of the front end surface. FIGS. 5C and 5D schematically illustrate such a modification made to the liquid absorber 9 of the third embodiment. FIG. 5C shows such a modified container for liquid replenishment 1 and FIG. 5D shows how the modified container for liquid replenishment 1 is fitted to a corresponding tank 3. As shown in FIG. 5C, the liquid absorber 9 is arranged along the outer periphery of the front end surface of the front end section 10 of the spout 7. With this modified embodiment again, as the front end surface of the front end section 10 of the spout 7 is made to show a centrally dented profile, the liquid droplets 6 that are likely to leak out from the liquid outlet 11 can be prevented from actually leaking out both by the effect of the inclined surface and by the absorption effect of the liquid absorber 9. Due to the doubled preventive effect, the effect of preventing the liquid droplets from actually leaking out will be satisfactory even if the volume of the liquid absorber 9 is made to be equal to ½ or ⅓ of the volume of the liquid absorber 9 shown in FIGS. 5A and 5B. Then, the material cost of the liquid absorber 9 can effectively be reduced. Furthermore, since the bottom surface 42 of the recess 41 of the tank 3 is made to be an inclined surface also in this modified embodiment, when the container for liquid replenishment 1 of this modified embodiment is fitted to the tank 3, the liquid droplets 6 squeezed out from the liquid absorber 9 can smoothly flow toward the droplet collection port 12. As the liquid droplet 6 are made to flow with ease, the risk that some of the squeezed out liquid droplets 6 stick back to the liquid absorber 9 is minimized so that the liquid droplets 6 can highly efficiently be fed back into the tank 3.

Fourth Embodiment

Figure 6A:
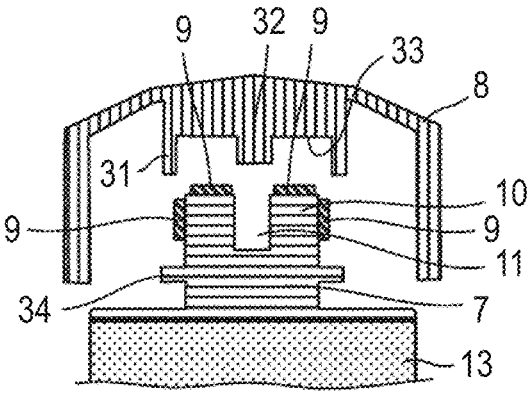
FIGS. 6A, 6B, 6C and 6D are schematic cross-sectional views of the fourth embodiment of container for liquid replenishment according to the present disclosure.
Figure 6B:
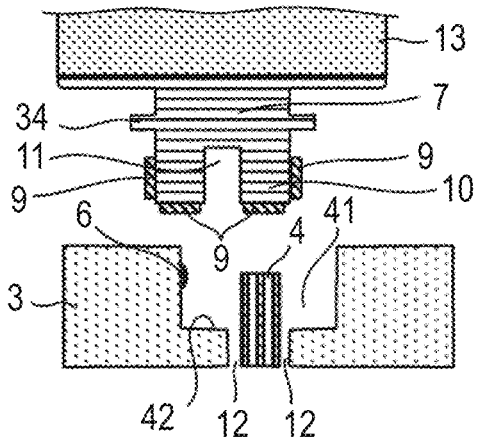
Figure 6C:
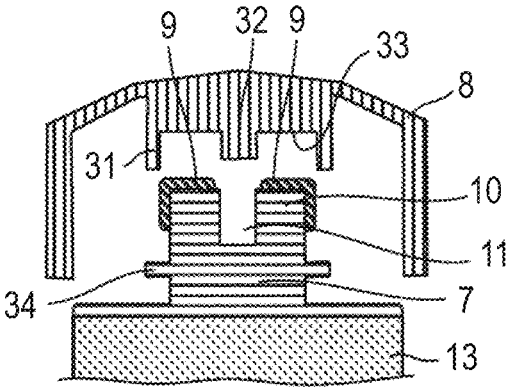
Figure 6D:
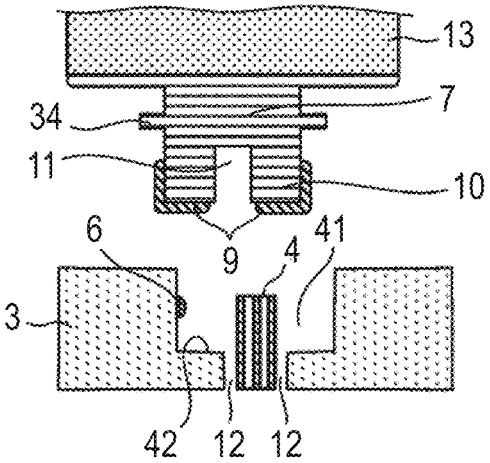

FIGS. 6A through 6D are schematic cross-sectional views of the container for liquid replenishment 1 of the fourth embodiment of the present disclosure. FIG. 6A shows a principal part of the container for liquid replenishment 1 and FIG. 6B shows the container for liquid replenishment 1 that is fitted to a corresponding tank 3. FIGS. 6C and 6D schematically illustrate an embodiment of container for liquid replenishment obtained by modifying the fourth embodiment, which will be described in greater detail hereinafter. As seen from FIGS. 6A and 6B, the container for liquid replenishment 1 of this embodiment resembles the container for liquid replenishment 1 of the first embodiment but differs from the first embodiment in that a liquid absorber 9 is arranged on part of the lateral surface of the front end section 10 of the spout 7 in addition to the liquid absorber 9 arranged on the front end surface of the front end section 10 of the spout 7. On the side of the corresponding tank 3, on the other hand, a droplet collection port 12 is arranged on the bottom surface 42 of the recess 41 of the tank 3 at a position located adjacent to the inlet flow path member 4 as in the instance of the above-described modified embodiment of the first embodiment. Since a liquid absorber 9 is arranged on part of the lateral surface of the spout 7 in addition to the liquid absorber 9 arranged on the front end surface of the front end section 10 of the spout 7 in this embodiment, the effect of preventing the recording liquid that has leaked out from the liquid outlet 11 to the outer surface of the spout 7 from splashing to the outside of this embodiment is intensified if compared with the corresponding effect of the first embodiment. Additionally, as seen from FIG. 6B, even when the liquid droplets 6 that have leaked out from the liquid outlet 11 partly adhere to the lateral wall of the recess 41 of the tank 3, such liquid droplets 6 can be removed by the liquid absorber 9 arranged on part of the lateral surface of the spout 7. Thus, the risk that the recording liquid leaking out from the container for liquid replenishment 1 and splashing out contaminates the outside can reliably be reduced further.

While two separate liquid absorbers 9 are arranged on the spout 7 of the embodiment shown in FIGS. 6A and 6B, one on the front end surface of the front end section 10 of the spout 7, the other on part of the lateral surface of the spout 7, alternatively, the two separate liquid absorbers 9 may integrally be formed. FIGS. 6C and 6D are schematic cross-sectional views of an embodiment obtained by modifying the fourth embodiment so as to unify the two separate liquid absorbers 9 of the fourth embodiment. FIG. 6C shows a principal part of the container for liquid replenishment 1 of this modified fourth embodiment and FIG. 6D shows how the container for liquid replenishment 1 of the modified fourth embodiment is fitted to a corresponding tank 3. In this modified embodiment, the integrally formed liquid absorber 9 is extended from the front end surface of the front end section 10 of the spout 7 so as to partly cover the lateral surface of the spout 7. Thus, with this modified fourth embodiment again, the risk that the recording liquid leaking out from the container for liquid replenishment 1 splashes out to the outside is reliably reduced. Additionally, since the single liquid absorber 9 can be fitted to the spout 7 simply by putting the liquid absorber 9, which is typically produced by molding, on the front end surface of the front end section 10 of the spout 7 to partly cover the spout 7, only a single step is required to rigidly attach the liquid absorber 9 to the spout 7 to consequently reduce the manufacturing cost of the container for liquid replenishment 1 if compared with the fourth embodiment shown in FIGS. 6A and 6B.

Fifth Embodiment

Figure 7:
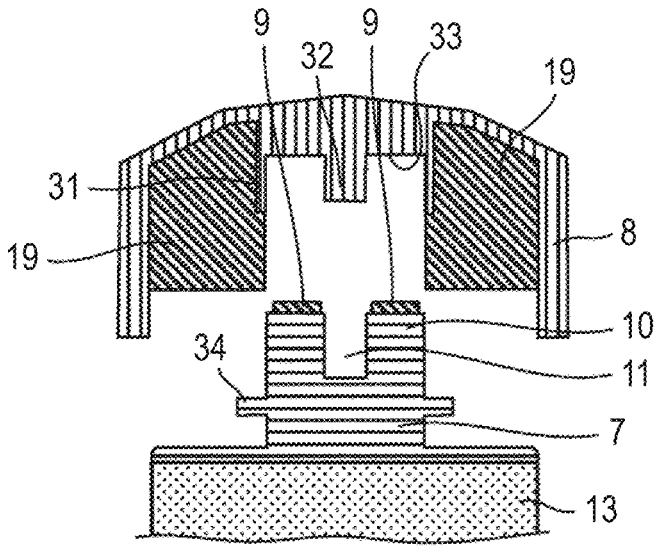
FIG. 7 is a schematic cross-sectional view of the fifth embodiment of container for liquid replenishment according to the present disclosure.

FIG. 7 is a schematic cross-sectional view of the container for liquid replenishment 1 of the fifth embodiment of the present disclosure, showing a principal part thereof. While the container for liquid replenishment 1 shown in FIG. 7 also resembles the container for liquid replenishment 1 of the first embodiment, an auxiliary absorber 19 is arranged around the tubular section 31 of the lid member 8 of the container for liquid replenishment 1 of this fifth embodiment. Preferably, the auxiliary absorber 19 is made to extend further downward from the lower end of the tubular section 31 as shown in FIG. 7 such that, when the lid member 8 is fitted to the container body 13, the auxiliary absorber 19 surrounds the lateral surface of the spout 7. The auxiliary absorber 19 is made of a material that can effectively absorb liquid and may be made of a material similar to the material of the liquid absorber 9. Since the auxiliary absorber 19 can be made to have a volume that is significantly greater than the volume of the liquid absorber 9 fitted to the spout 7, if an accident of leakage of recording liquid takes place, the amount of recording liquid that can be absorbed by the container for liquid replenishment 1 of this fifth embodiment will be enormous if compared with the preceding embodiments. For example, even when the internal seal member (not shown) of the container for liquid replenishment 1 is broken by accident and the container for liquid replenishment 1 is toppled sideways to pour out a large volume of recording liquid from the liquid outlet 11, the auxiliary absorber 19 can hold the recording liquid that has poured out in the inside of the container for liquid replenishment 1, including the lid member 8 thereof. Note that the arrangement of an auxiliary absorber 19 described above for the fifth embodiment is also applicable to the second through fourth embodiments.

Each and every one of the above-described preferable embodiments of the present disclosure can reliably reduce the risk that recording liquid leaks out from the container for liquid replenishment 1 in a state where the lid member 8 is fitted to the container body 13. Even when the recording liquid that has leaked out splashes around the corresponding tank 3 to contaminate the tank 3 with the recording liquid, the recording liquid that has splashed around can at least be removed by wiping the recording liquid with the liquid absorber 9 arranged on the front end surface of the front end section 10 of the spout 7 and causing the liquid absorber 9 to absorb the recording liquid that the liquid absorber 9 has wiped. Thereafter, when the container for liquid replenishment 1 is fitted to the recess 41 of the corresponding tank 3, the liquid absorber 9 fitted to the spout 7 will be compressed and the recording liquid that has been absorbed by the liquid absorber 9 will be squeezed out. When a droplet collection port 12 is provided in the tank 3 to collect the squeezed-out liquid droplets, the collected liquid droplets can automatically be fed into the tank 3. When a liquid absorber 9 is arranged on the lid member 8, the recording liquid absorbed by the liquid absorber 9 will ultimately be discarded with the lid member 8. However, to the contrary, when a liquid absorber 9 is arranged on the side of the spout 7 such that the liquid droplets 6 that have leaked out can be collected by way of the droplet collection port 12, the loss of recording liquid attributable to the recording liquid that leaks out from the inside of the container for liquid replenishment 1 and is subsequently discarded can reliably be minimized.

In the description given above for each of the embodiments of the present disclosure, the inkjet recording apparatus 2 is an apparatus that requires liquid for its operation and the tank 3 is part of such an apparatus. Then, the recess 41 formed on the top surface of the tank 3, the inlet flow path member 4, the droplet collection port 12, the inlet flow path member 4 and the droplet collection port 12 being arranged in the recess 41, and the container for liquid replenishment 1 form a liquid replenishment structure for replenishing liquid to the apparatus that requires liquid for its operation. Therefore, a liquid replenishment structure according to the present disclosure typically comprises a container for liquid replenishment 1, a recess 41 arranged in a tank 3 so as to be able to accept a spout 7 and an inlet flow path member 4 arranged in the recess 41 so as to be put into the liquid outlet 11 of the container for liquid replenishment 1. Additionally, a droplet collection port 12 for collecting the liquid droplets that are squeezed out from the liquid absorber 9 when the container for liquid replenishment 1 is fitted to the tank 3 and the liquid absorber 9 is pinched between the spout 7 of the container for liquid replenishment 1 and the recess 41 of the tank 3 and compressed is arranged on the bottom surface 42 of the recess 41.

Thus, according to the present disclosure, there are provided a container for liquid replenishment that can minimize the risk that liquid splashes around the inlet flow path member of a liquid ejection apparatus when the container for liquid replenishment is fitted to a tank arranged in the liquid ejection apparatus and hence reduce the loss of liquid due to such splashing of liquid and a liquid replenishment structure that involves the use of such a container for liquid replenishment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-062943, filed Mar. 31, 2020, which is hereby incorporated by reference herein in its entirety.

What is claimed is:

1. A container for liquid replenishment for replenishing liquid in a liquid ejection apparatus, the container comprising:

a container body capable of containing the liquid;

a spout fitted to the container body and having a front end section including a front end surface and a liquid outlet for allowing the liquid to flow out therefrom;

a lid member attached to the spout to cover the spout in such a manner that the lid member can be removed for liquid replenishment; and a liquid absorber fixed on the spout, the liquid absorber having a front surface on a side opposite to a surface fixed on the spout such that the front surface is exposed when the lid member is removed;

the liquid outlet being open in the front end surface of the spout;

the liquid absorber being arranged at least on an area of the front end surface not occupied by the liquid outlet.

2. The container according to claim 1, wherein the lid member has a tubular section configured to receive the front end section of the spout such that, as the lid member is attached to the spout, the front end section extends into the inside of the tubular section.

3. A container for liquid replenishment for replenishing liquid in a liquid ejection apparatus, the container comprising:

a container body capable of containing the liquid;

a spout fitted to the container body and having a front end section including a front end surface and a liquid outlet for allowing the liquid to flow out therefrom;

a lid member removably attached to the spout to cover the spout; and a liquid absorber arranged on the spout;

the liquid outlet being open in the front end surface of the spout;

the liquid absorber being arranged at least on an area of the front end surface not occupied by the liquid outlet, wherein the lid member has a tubular section configured to receive the front end section of the spout such that, as the lid member is attached to the spout, the front end section extends into the inside of the tubular section, and wherein an auxiliary absorber is arranged around the tubular section of the lid member such that, as the lid member is attached to the spout, the auxiliary absorber surrounds the spout.

4. A container for liquid replenishment for replenishing liquid in a liquid ejection apparatus, the container comprising:

a container body capable of containing the liquid;

a spout fitted to the container body and having a front end section including a front end surface and a liquid outlet for allowing the liquid to flow out therefrom;

a lid member removably attached to the spout to cover the spout; and a liquid absorber arranged on the spout;

the liquid outlet being open in the front end surface of the spout;

the liquid absorber being arranged at least on an area of the front end surface not occupied by the liquid outlet, wherein the lid member has a tubular section configured to receive the front end section of the spout such that, as the lid member is attached to the spout, the front end section extends into the inside of the tubular section, and wherein the front end surface has a profile comprising a central side and an outer peripheral side such that the central side protrudes more than the outer peripheral side.

5. A container for liquid replenishment for replenishing liquid in a liquid ejection apparatus, the container comprising:

a container body capable of containing the liquid;

a spout fitted to the container body and having a front end section including a front end surface and a liquid outlet for allowing the liquid to flow out therefrom;

a lid member removably attached to the spout to cover the spout; and a liquid absorber arranged on the spout;

the liquid outlet being open in the front end surface of the spout;

the liquid absorber being arranged at least on an area of the front end surface not occupied by the liquid outlet, wherein the lid member has a tubular section configured to receive the front end section of the spout such that, as the lid member is attached to the spout, the front end section extends into the inside of the tubular section, and wherein the front end surface has a profile comprising a central side and an outer peripheral side such that the outer peripheral side protrudes more than the central side.

6. The container according to claim 5, wherein the liquid absorber is arranged along an outer periphery of the front end surface.

7. A container for liquid replenishment for replenishing liquid in a liquid ejection apparatus, the container comprising:

a container body capable of containing the liquid;

a spout fitted to the container body and having a front end section including a front end surface and a liquid outlet for allowing the liquid to flow out therefrom;

a lid member removably attached to the spout to cover the spout; and a liquid absorber arranged on the spout;

the liquid outlet being open in the front end surface of the spout;

the liquid absorber being arranged at least on an area of the front end surface not occupied by the liquid outlet, wherein the lid member has a tubular section configured to receive the front end section of the spout such that, as the lid member is attached to the spout, the front end section extends into the inside of the tubular section, and wherein the liquid absorber is also arranged on a lateral surface of the spout.

8. The container according to claim 7, wherein the liquid absorber on the front end surface and the liquid absorber on the lateral surface of the spout are unified to form an integral liquid absorber.

9. A liquid replenishment structure comprising:

a container for liquid replenishment for replenishing liquid in a liquid ejection apparatus, the container having a container body capable of containing the liquid, a spout fitted to the container body and having a front end section including a front end surface and a liquid outlet for allowing the liquid to flow out therefrom, a lid member removably attached to the spout to cover the spout and a liquid absorber arranged on the spout, the liquid outlet being open in the front end surface of the spout, the liquid absorber being arranged at least on an area of the front end surface not occupied by the liquid outlet;

a recess arranged in the liquid ejection apparatus and adapted for receiving the spout of the container for liquid replenishment;

an inlet flow path member arranged in the recess and configured to be inserted into the liquid outlet of the container for liquid replenishment; and a droplet collection port arranged at a bottom surface of the recess so as to collect liquid droplets squeezed out from the liquid absorber upon being pinched and compressed between the spout and the recess in response to an operation of fitting the container for liquid replenishment to the liquid ejection apparatus.

10. A liquid replenishment structure comprising:

a container for liquid replenishment for replenishing liquid in a liquid ejection apparatus, the container having a container body capable of containing the liquid, a spout fitted to the container body and having a front end section including a front end surface and a liquid outlet for allowing the liquid to flow out therefrom, a lid member removably attached to the spout to cover the spout and a liquid absorber arranged on the spout, the liquid outlet being open in the front end surface of the spout, the liquid absorber being arranged at least on an area of the front end surface not occupied by the liquid outlet;

a recess arranged in the liquid ejection apparatus and adapted for receiving the spout of the container for liquid replenishment;

an inlet flow path member arranged in the recess and configured to be inserted into the liquid outlet of the container for liquid replenishment; and a droplet collection port arranged at a bottom surface of the recess so as to collect liquid droplets squeezed out from the liquid absorber upon being pinched and compressed between the spout and the recess in response to an operation of fitting the container for liquid replenishment to the liquid ejection apparatus, wherein the front end surface has a profile comprising a central side and an outer peripheral side such that the central side protrudes more than the outer peripheral side, the inlet flow path member is arranged in a central section of the recess, and the droplet collection port is arranged at a position located adjacent to the inlet flow path member in the bottom surface of the recess.

11. The liquid replenishment structure according to claim 10, wherein the bottom surface of the recess has a profile that is inclined downwardly from an outer peripheral side toward a central side.

12. A liquid replenishment structure comprising:

a container for liquid replenishment for replenishing liquid in a liquid ejection apparatus, the container having a container body capable of containing the liquid, a spout fitted to the container body and having a front end section including a front end surface and a liquid outlet for allowing the liquid to flow out therefrom, a lid member removably attached to the spout to cover the spout and a liquid absorber arranged on the spout, the liquid outlet being open in the front end surface of the spout, the liquid absorber being arranged at least on an area of the front end surface not occupied by the liquid outlet;

a recess arranged in the liquid ejection apparatus and adapted for receiving the spout of the container for liquid replenishment;

an inlet flow path member arranged in the recess and configured to be inserted into the liquid outlet of the container for liquid replenishment; and a droplet collection port arranged at a bottom surface of the recess so as to collect liquid droplets squeezed out from the liquid absorber upon being pinched and compressed between the spout and the recess in response to an operation of fitting the container for liquid replenishment to the liquid ejection apparatus, wherein the front end surface has a profile comprising a central side and an outer peripheral side such that the outer peripheral side protrudes more than the central side, the inlet flow path member is arranged in a central section of the recess, and the droplet collection port is arranged in an outer peripheral section of the bottom surface of the recess.

13. The liquid replenishment structure according to claim 12, wherein the bottom surface of the recess has a profile that is inclined upwardly from an outer peripheral side toward a central side.

* * * * *